United States Patent [19]

Wessels et al.

[11] 4,214,621

[45] Jul. 29, 1980

[54] AWNING MECHANISM

[75] Inventors: Bernhard Wessels, Rheine; Adolf Fugger, Greven, both of Fed. Rep. of Germany

[73] Assignee: Schmitz-Werke GmbH & Co., Emsdetten, Fed. Rep. of Germany

[21] Appl. No.: 941,846

[22] Filed: Sep. 12, 1978

[30] Foreign Application Priority Data

Oct. 19, 1977 [DE] Fed. Rep. of Germany ..... 2746848

[51] Int. Cl.[2] ..... E04F 10/06

[52] U.S. Cl. ..... 160/66; 160/68

[58] Field of Search ..... 160/22, 25, 66–75

[56] References Cited

U.S. PATENT DOCUMENTS

| | | | |
|---|---|---|---|
| 618,906 | 2/1899 | Reimer | 160/67 |
| 800,111 | 9/1905 | James | 160/25 |
| 1,326,801 | 12/1919 | Stecker et al. | 160/70 |
| 4,077,419 | 3/1978 | Lux | 135/5 AT |

*Primary Examiner*—Peter M. Caun

*Attorney, Agent, or Firm*—Browdy and Neimark

[57] ABSTRACT

Awning mechanism for store-front awnings and the like to provide protection against sunlight, rain, etc. The awning mechanism includes a primary awning roller on which the awning cloth is wound and which is provided with means for imparting rotation thereto. A parallel drop tube is affixed to scissor-jack extension arms which hold the drop tube at variable distances from the primary awning roller. In one embodiment of the invention, the drop tube contains a rotatable reversing roller and a longitudinal slot which permits looping the awning cloth over the reversing roller. After the awning cloth emerges from the drop tube, it depends freely therefrom to constitute a flyer of variable length. The reversing roller is provided with separate rotating means so as to permit an independent adjustment of the length of the dependent portion of the awning. In a second embodiment of the invention, the flyer is a separate piece of awning material which is wound up on a flyer shaft mounted rotatably within the drop tube while the terminal edge of the principal awning is affixed in the top of the drop tube by being held in a longitudinal groove.

5 Claims, 4 Drawing Figures

AWNING MECHANISM

FIELD OF THE INVENTION

The invention relates to an awning mechanism, for example for store-front awnings in which a movable framework supports a cloth or other web for protection against sun, rain, etc. More particularly, the invention relates to an awning mechanism which includes a principal and drivable roller for holding the awning cloth and a drop tube, the distance to which is variable, and which supports the awning cloth at its end remote from the principal roller. Depending from the drop tube is a free-hanging section of cloth, referred to as a flyer.

BACKGROUND OF THE INVENTION

Awnings of the type described above are known. In the usual case, the awning mechanism includes a carrier frame which is attached, for example, to the wall of a house or store front. The carrier frame includes extension arms, at the end of which there is disposed a drop tube. The extension arms may be changed in length. In order to insure that the drop tube tends to move away from the principal roller when the awning cloth is rolled off, the extension arms are so disposed as to cause the motion of the drop tube to be slightly inclined downwardly from a horizontal plane. In this manner, the effect of gravity causes the extension of the awning when the cloth is unrolled from the principal roller. In order to adapt the position of the awning to afford protection against various angles of incidence of sunlight, for example, it is known in the art to provide a capability to pivot the entire awning including a part of the carrier frame for the principal roller with respect to the wall to which it is attached and about a horizontal axis. In this manner, the entire awning may be inclined drastically with respect to a horizontal plane. A variable mechanism of this type requires an extraordinarily heavy and robust carrier frame however. A further disadvantage of the known mechanism is that when the awning is inclined substantially, the lower parts thereof may descend to the level of pedestrians and interfere with their free passage.

OBJECT AND SUMMARY OF THE INVENTION

It is thus a principal object of the present invention to provide an awning of the general type described above which permits the ready adaptation to varying angles of incidence of sunlight in relatively simple manner and in particular without thereby altering the angle of extension of the overall awning mechanism.

The principal object of the invention is attained in that the freely depending part of the awning, i.e., the so-called flyer, can be changed readily in length. Due to this provision, the main angle of extension of the awning with respect to the space that it protects remains unchanged. The length of the freely dependent flyer is changed in accordance with the angle of incidence of sunlight so that adequate protection against the sun may be obtained without lowering the awning mechanism below its normal height. It is a particular feature of the invention that the flyer may be caused to disappear entirely. If a flyer of sufficient length is caused to fall from the drop tube it may serve additionally as protection against wind or rain.

It is a particularly advantageous feature of the invention that the awning cloth and the flyer can be of one single piece of material and that the awning cloth is attached to the drop tube at different places, thereby causing a variable length of the depending flyer. In accordance with the desired length of the flyer, the point of attachment of the awning cloth at the drop tube is selected. Thereafter, the relative distance of the drop tube from the principal roller is determined by rolling the cloth onto or off the principal roller.

It has been found to be particularly advantageous to dispose within the drop tube a rotatable internal reversing roller and to provide an axial slot within the drop tube. In this manner the awning cloth can be introduced into the drop tube and looped around the reversing roller. Thereafter, it emerges from the drop tube to constitute the aforementioned freely depending flyer. The above-mentioned disposition causes all mechanisms which determine the length of the awning and of the flyer to be disposed within the drop tube and out of sight. The degree of looping of the awning cloth around the reversing roller is such that the friction provides a sufficiently fixed positioning of the awning cloth and hence of the length of the flyer, provided that the reversing roller is prevented from rotating. The length of the flyer may be adjusted particularly well if the reversing roller can be driven in rotation, e.g. manually by suitable self-locking gears with crank drive such as are already in use for rotating the principal rollers of awning mechanisms. However, the drive mechanism for the reversing roller may also be electrical with the interposition of a self-locking gear train, as is also already known for driving the principal awning roller. Still another possibility is to provide only a locking mechanism for the reversing roller and to adjust the length of the flyer by releasing the lock and manually pulling the awning cloth from the drop tube after lifting it and releasing the load thereon.

In a second advantageous embodiment of the invention, the drop tube contains a rotatable flyer shaft on which the flyer is mounted and on which it may be wound up by a suitable mechanism. In this embodiment, the flyer is a separate piece of cloth which is wound up on the flyer shaft in the manner of a secondary awning.

Further advantages and characteristics of the invention will become apparent from a detailed description which relates to the drawing.

DETAILED DESCRIPTION OF THE INVENTION

Figure 1:
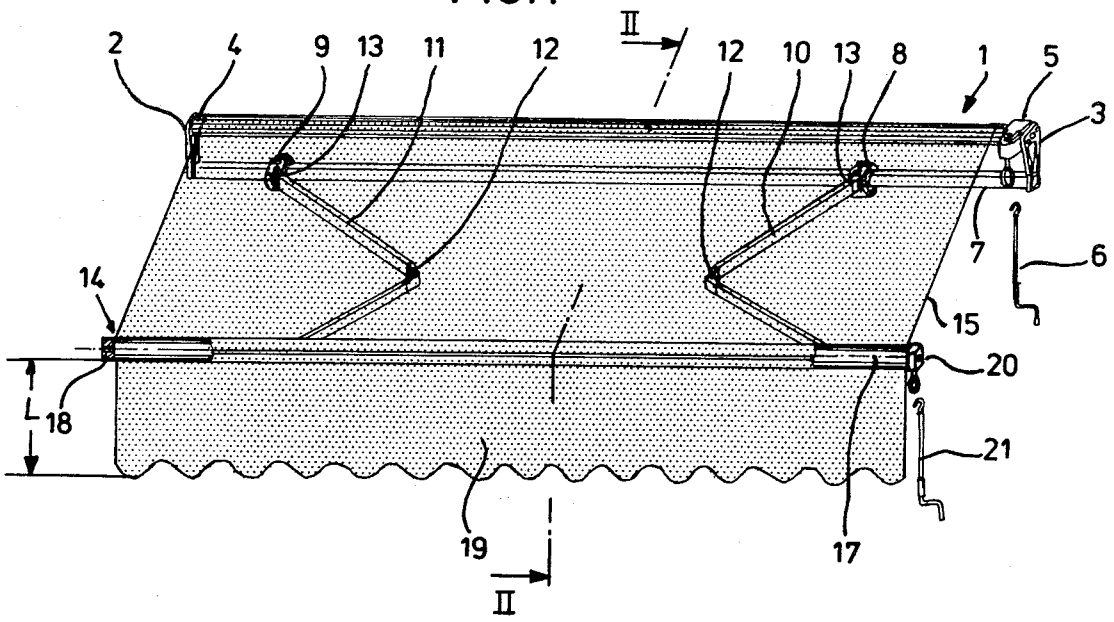
FIG. 1 is a perspective view of an awning mechanism according to the invention as seen from above.

The awning mechanism illustrated in FIG. 1 includes a carrier frame 1 which is attached to the vertical wall of a house or the like by suitable means of attachment. The mechanism 1 includes bearing assemblies 2, 3 which hold a primary awning roller 4 which may be driven in rotation by suitable means, for example as illustrated in FIG. 1, by a self-locking gear train 5 which is rotated by a releasable crank 6. The place of the gear train 5 and crank 6 may be taken, as is known in the art, by an electric drive mechanism, for example a gear or belt drive or the like. The carrier frame 1 further includes a carrier rod 7 disposed between the two bearing assemblies 2 and 3. Attached by means of shackles 8, 9 which can glide on the carrier rod 7 are folding extensions arms 10, 11 which are disposed in the manner of a scissor jack and which have a central pivotal joint 12 having a vertical pivotal axis. The arms 10, 11 are joined to the shackles 8, 9 by similar pivotal joints 13. The other ends of the arms 10, 11 are joined with pivotal joints similar to joints 13 to a drop tube 14. It will be appreciated that due to the construction of the aforementioned elements, the drop tube may be displaced in the plane containing the primary awning roller 4 but is prevented from executing any motions which would be vertical to that plane.

Attached to the primary awning roller 4 is one end of a substantially rectangular awning cloth 15 which may be wound onto and off the primary roller 4 by means of the rotations imparted thereto. In a manner to be explained in detail below, the awning cloth 15 is also attached to the drop tube 14. The carrier frame 1, the carrier rod 7 and the extension arms 10, 11 are so disposed with respect to one another that the plane defined by the awning cloth during the extension of the mechanism is inclined below a horizontal plane, so as to cause the gravitational forces to urge the drop tube to move away from the primary awning roller when the latter is released, thereby causing a slight tensioning of the awning cloth 15 while the extension arms 10, 11 are being extended. The aforementioned construction and manner of operation of the awning mechanism is substantially similar to the known apparatus.

Figure 2:
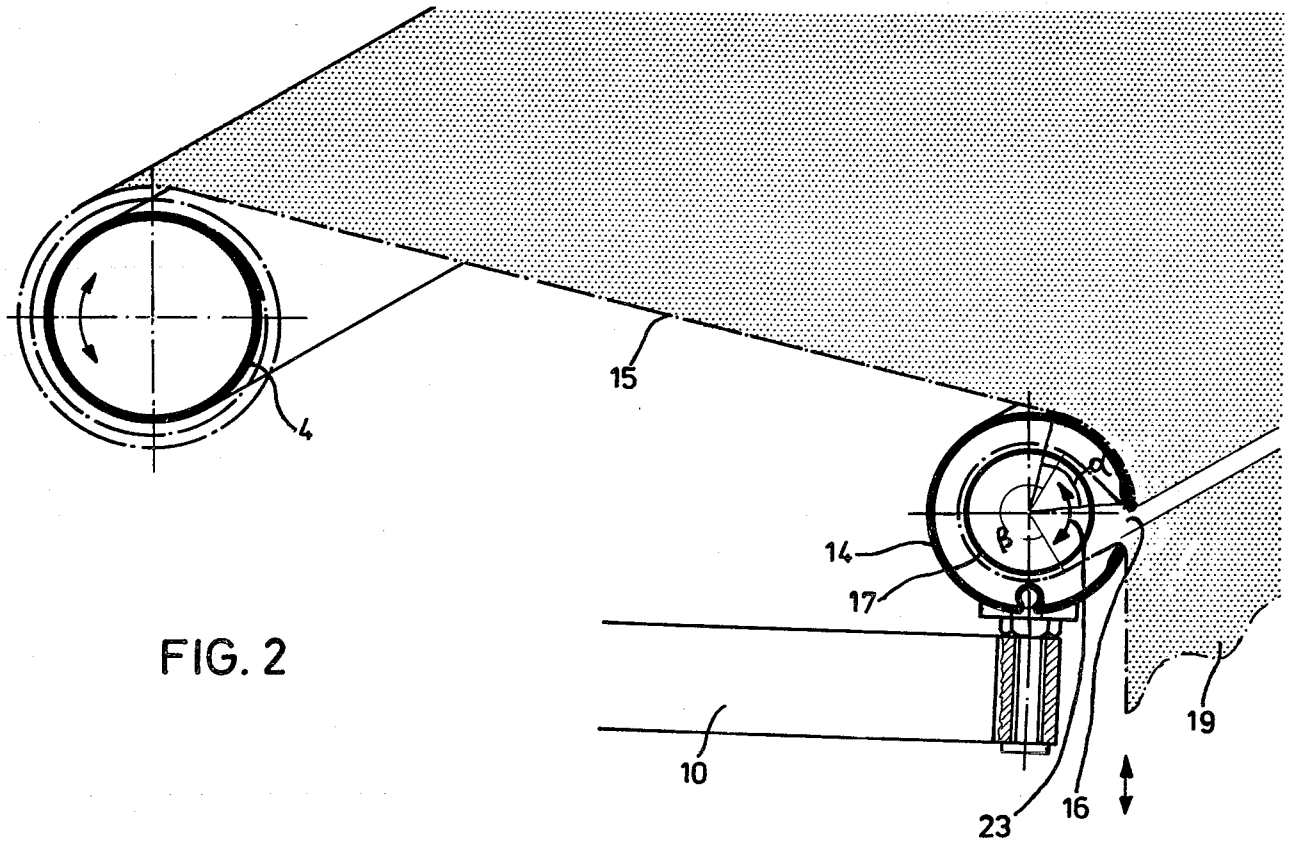
FIG. 2 is a partially sectional view through the perspective drawing of FIG. 1 along the line II—II.

In a first exemplary embodiment of the novel features of the invention, as illustrated in FIGS. 1 and 2, the drop tube 14 is provided with a longitudinal slot 16, disposed on the front of the drop tube 14, i.e., on that part of its surface facing away from the primary awning roller 4. Disposed within the drop tube 14 and coaxially therewith is a reversing roller 17 which is rotatably mounted in two bearings 18 disposed at respective ends of the drop tube 14.

The manner of attachment of the awning cloth to the aforementioned elements is as follows. The awning cloth is guided from the primary roller 4 over the top of the drop tube 14 into its longitudinal slot 16 which is at least wide enough to accommodate the full width of the cloth 15. The looping angle, i.e., the angle between the two lines of tangency of the awning cloth on the exterior of the drop tube, which is labeled $\alpha$ in FIG. 2, is approximately equal to or somewhat less than 90°. It is intended that the angle $\alpha$ be no less than 60°. The awning cloth 15 then continues through the longitudinal slot 16 into the interior of the drop tube 14 where it is looped around the reversal roller 17. The looping angle $\beta$ of the cloth 15 around the reversing roller 17 is at least 180°. After looping the reversal roller 17, the awning cloth 15 is led out of the longitudinal slot 16 and continues as a freely dependent flyer 19 which is shown to extend vertically from the drop tube 14. When the reversing roller 17 is secured against rotation with respect to the drop tube 14, the frictional forces between the awning cloth 15 and the corresponding surfaces of the reversing roller and the drop tube over the looping angles $\beta$ and $\alpha$ are sufficient to prevent any change of the vertical length L of the flyer with respect to the drop tube 14 even during rotation of the primary roller 4 when the awning cloth 15 is wound onto or off from the primary roller 4. Independent rotation of the reversing roller 17 in one or the other directions causes a lengthening or shortening of the flyer 19 with respect to drop tube 14. The friction between the reversing roller 17 and the awning cloth 15 may be increased by providing the surface of the reversing roller 17 with a rubberized coating or by providing a roughening of its surface.

The rotary drive mechanism for the reversing roller 17 may be a self-locking gear train 20 suitably engaged by a possibly releasable extended crank 21. The actuation mechanism may be similar to that which rotates the primary awning roller 4. Depending on the direction of rotation of the crank 21, the reversing roller 17 is rotated in one of the directions indicated schematically by the double arrow 23. The place of the self-locking gear train 20 may be taken by a known electric motor drive or a hand wheel.

Figure 3:
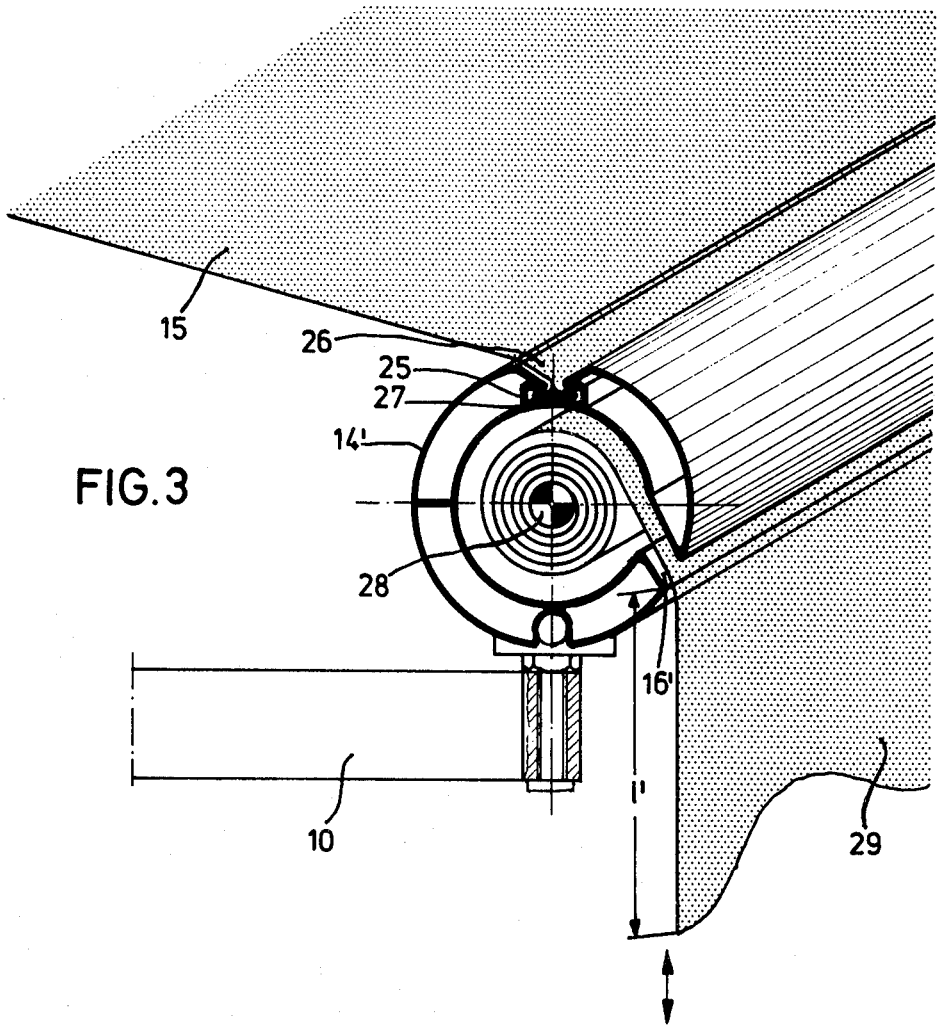
FIG. 3 is a sectional view of a second embodiment of the invention.
Figure 4:
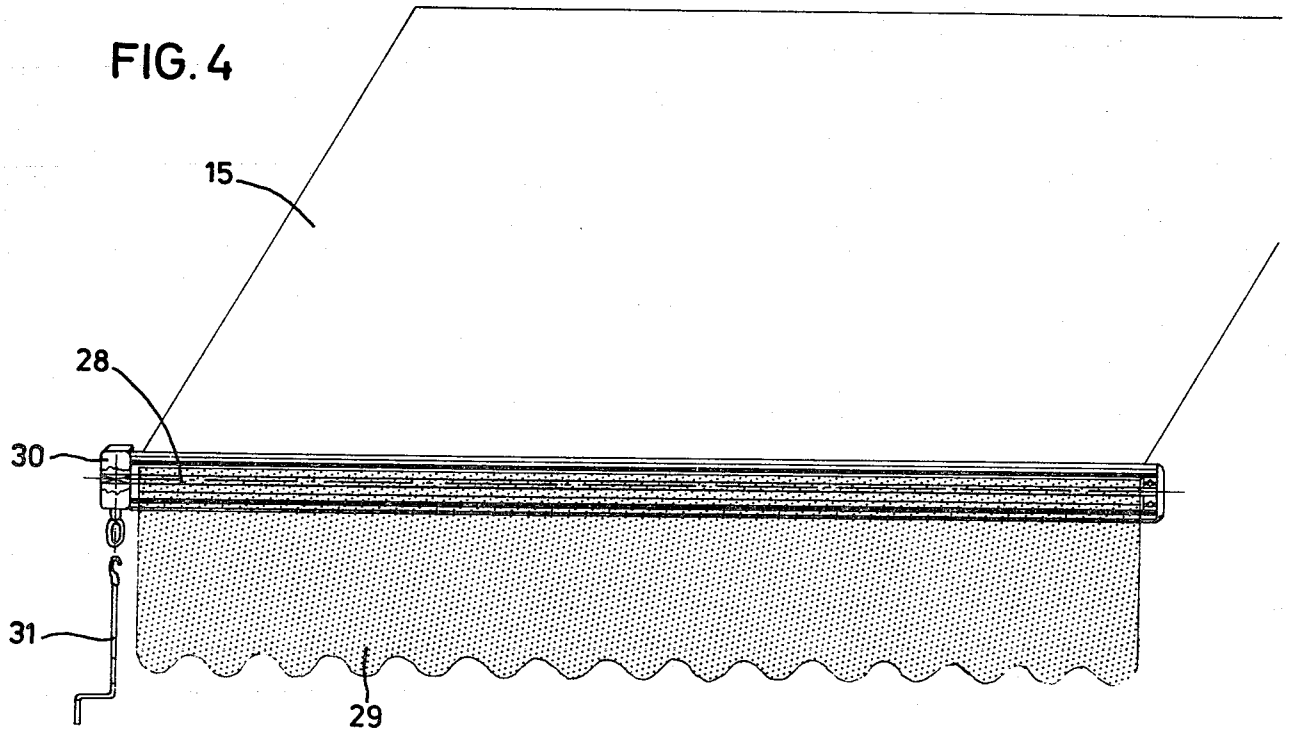
FIG. 4 is an axial section through the drop tube illustrated in FIG. 3.

In a second exemplary embodiment of the invention illustrated in FIG. 3, the leading edge of the awning cloth 15 is attached to the drop tube 14' in known manner by means of a seam 26 which is placed within a channel 25 in the surface of the drop tube and is locked there by the insertion of a locking slat 27. This manner of fastening the edge of the awning within the drop tube is known. The drop tube 14' according to the invention is provided, as in the first exemplary embodiment, with a longitudinal slot 16'. Disposed coaxially within the drop tube 14' is a flyer shaft 28 to which is attached a flyer 29 whose freely depending end of length L' may be rolled up or down by rotating the shaft 28. The rotation of the shaft 28 may be instituted by any suitable mechanism, for example any one of the mechanisms previously discussed with respect to the first exemplary embodiment. Accordingly, the drop tube 14' contains, for example, a self-locking gear train 30 which is actuated by means of a crank 31 to cause rotation of the shaft 28 and the attendant winding-up or releasing of the flyer 29. In the second exemplary embodiment according to FIG. 3, which is further illustrated in longitudinal section in FIG. 4, the flyer 29 is a separate piece of awning material whose length is determined independently of the extent of the principal awning.

The scope of the invention is understood to include further embodiments and variants not explicitly disclosed above, the illustrated embodiments serving only for purposes of explanation.

What is claimed:

1. An awning mechanism, comprising frame means for attachment to a vertical surface and including:

a primary awning roller on which an awning cloth may be wound;

first drive means for imparting rotary motion to said primary roller;

extension means for supporting a drop tube at varying distances from said primary awning roller, said drop tube serving to support and hold a part of said awning cloth and further serving to hold a freely depending part of awning cloth defining a flyer of variable length; and further comprising means within said drop tube for permitting said drop tube to hold said awning cloth at varying parts thereof, and wherein said awning cloth and said flyer are constituted by a single integral piece of material.

2. An awning mechanism according to claim 1, wherein there is disposed coaxially within said drop tube a rotatable reversing roller, including means for preventing the rotation thereof, said drop tube being provided with a longitudinal slot permitting entry and exit of said awning cloth and interior looping of said reversing roller; whereby said awning cloth constitutes said flyer after emergence from said longitudinal slot.

3. An awning mechanism according to claim 2, further comprising means for providing rotary motion to said reversing roller.

4. An awning mechanism according to claim 3, wherein said longitudinal slot is provided in the surface of said drop tube remote from said primary awning roller and the angle defined between the line of tangency of said awning cloth on the surface of said drop tube and said longitudinal slot is greater than 60°.

5. An awning mechanism, comprising frame means for attachment to a vertical surface and including:

a primary awning roller on which an awning cloth may be wound;

first drive means for imparting rotary motion to said primary roller;

extension means for supporting a drop tube at varying distances from said primary awning roller, said drop tube serving to support and hold a part of said awning cloth and further serving to hold a freely depending part of awning cloth defining a flyer of variable length; and further comprising a rotatable flyer shaft disposed coaxially within said drop tube and including means for imparting rotation thereto, the flyer being a separate cloth rolled up to varying degrees on said flyer shaft and said drop tube including means for fixedly holding the terminal edge of said awning cloth and said drop tube further including a longitudinal slot for permitting emergence of said flyer therefrom.

* * * * *